US006102558A

United States Patent [19]

Farnoux

[11] Patent Number: 6,102,558

[45] Date of Patent: Aug. 15, 2000

[54] MOTOR VEHICLE HEADLIGHT WITH A REFLECTOR FOR GENERATING A WIDE BEAM, AND WITH A STRIATED COVER LENS

[75] Inventor: Thierry Farnoux, Boulogne Billancourt, France

[73] Assignee: Valeo Vision, Bobigny, France

[21] Appl. No.: 09/081,981

[22] Filed: May 20, 1998

[30] Foreign Application Priority Data

May 23, 1997 [FR] France ..... 97 06305

[51] Int. Cl.[7] ..... F21V 13/04

[52] U.S. Cl. ..... 362/518; 362/516; 362/522; 362/309; 362/348

[58] Field of Search ..... 359/599, 628; 362/518, 522, 516, 520, 348, 349, 309

[56] References Cited

U.S. PATENT DOCUMENTS

| | | | |
|---|---|---|---|
| 4,272,801 | 6/1981 | Fratty | 362/522 |
| 4,481,563 | 11/1984 | Snyder et al. | 362/518 |
| 4,545,007 | 10/1985 | Nagel | 362/329 |
| 4,959,757 | 9/1990 | Nakata | 362/518 |
| 5,215,368 | 6/1993 | Neumann | 362/518 |
| 5,567,044 | 10/1996 | Lopez | 362/518 |
| 5,902,036 | 5/1999 | Serizawa et al. | 362/308 |

FOREIGN PATENT DOCUMENTS

| | | | |
|---|---|---|---|
| 0 466 605 | 1/1992 | European Pat. Off. | F21M 3/08 |
| 1 024 727 | 11/1953 | France . | |
| 33 22 181 | 1/1985 | Germany | B60Q 1/00 |
| 2 136 943 | 9/1984 | United Kingdom | F21V 5/04 |

OTHER PUBLICATIONS

French Search Report dated Jan. 30, 1998.

*Primary Examiner*—Cassandra Spyrou
*Assistant Examiner*—John Juba, Jr.
*Attorney, Agent, or Firm*—Morgan & Finnegan, LLP

[57] ABSTRACT

A motor vehicle headlight comprising a light source, a reflector and a cover lens. The reflector generates a preformed light beam such that its modification by any optical elements on the cover lens is unnecessary. The cover lens receives, from at least a substantial part of the reflector, radiation having a mean angle of incidence in a horizontal plane which varies progressively with horizontal displacement over the cover lens. The cover lens includes a set of striations for lateral deflection of the light, with each striation having an individual angular distribution law which is determined by the orientation of the light from the reflector and by the lateral spreading characteristic of the striation. The spreading characteristics of the striations are determined in such a way that the aggregate angular distribution law of the different striations has a curve which is essentially flat.

15 Claims, 4 Drawing Sheets

MOTOR VEHICLE HEADLIGHT WITH A REFLECTOR FOR GENERATING A WIDE BEAM, AND WITH A STRIATED COVER LENS

FIELD OF THE INVENTION

The present invention relates in general terms to motor vehicle headlights.

BACKGROUND OF THE INVENTION

There is at the present time a tendency, in the design of motor vehicle headlights, to design the reflector of the headlight in such a way that it will produce by itself a beam having the desired photometric distribution. This photometric distribution consists in particular of giving the beam the required width with satisfactory homogeneity, that is to say, as far as possible, a beam without any undesirable bright spots or dim spots, and also to give the beam the required vertical distribution by delimiting the beam as necessary with a cut-off of a type which can be varied. Such cut-offs exist in particular for European dipped beams, American dipped beams, foglight beams, and so on.

This particular design of the reflector, which has begun to appear on motor cars and other touring vehicles, enables a cover lens to be used which may be entirely smooth or nearly smooth, that is to say it only has decorative elements such as fillets and the like, which play no significant part in the structure of the beam produced by the headlight.

In combination, these characteristics have two main advantageous effects. The first of these is that downward deflection of the light is avoided, the light being widely spread by conventional optical striations where they are formed on a cover lens which is sharply inclined in its vertical axial sections. The second of these advantages is that an aesthetically pleasing headlight is obtained.

However, most recently there has been a tendency to make use of striated cover lenses, particularly with a view to masking as far as possible any defects existing in the material of the lens itself (which may be of glass or of a plastics material), or in the surface of the reflector. Such defects may consist of varnishing faults, the presence of dust, slight scratches, and so on. At the same time, it remains desirable to retain the same reflector design, because this enables beams to be produced which give extreme satisfaction in terms of the photometric distribution obtained.

A difficulty does however arise from the fact that if, in a headlight of the prior art, striations are applied on a cover lens which is placed in front of such a reflector, the photometric qualities of the beam will be unfailingly affected detrimentally.

DISCUSSION OF THE INVENTION

A primary object of the invention is to remove this difficulty, and to propose a striated structure which can be applied on a cover lens placed in front of a reflector of the above mentioned type, without however significantly altering the photometry of the beam which is produced.

According to the invention in a first aspect, a motor vehicle headlight, comprising a light source, a reflector and a cover lens, the reflector being adapted to produce a pre-formed light beam in such a way that the intervention of optical elements on the lens is unnecessary, the lens receiving, from at least a substantial part of the reflector, divergent radiation having a mean angle of incidence in a horizontal plane which varies progressively with horizontal displacement on the lens, is characterised in that the lens includes, at least in a zone covered by the divergent radiation, a set of striations for lateral deflection of the light, the said striations being exposed to the said divergent radiation, in that each striation defines an individual angular distribution law which is determined by the orientation of the light which it receives from the said part of the reflector and by the lateral distribution characteristic of the striation, and in that the spreading characteristics of the striations are determined in such a way that the aggregate law of angular distribution for the various striations is essentially uniform.

According to a preferred feature of the invention, the profile of each striation has, in a horizontal plane, a radius of curvature which is smaller in the region of its side edges than in its central region.

Preferably, the radius of curvature of each striation diminishes progressively from the central region of the striation towards its edges.

According to a further preferred feature of the invention, the curve of each individual angular distribution law overlaps the curves of at least two other neighbouring angular distribution laws.

All the striations preferably have the same profile.

Preferably, the lens includes a zone from which striations are absent.

The striations are preferably concave.

According to another preferred feature of the invention, the striations are arranged on a pitch which is slightly greater than their width, and rounded transitions are defined between adjacent striations.

In preferred embodiments of the invention, each rounded transition has a constant radius of curvature, which is equal to the radius of a single cylindrical milling cutter which is used for machining a mould for making the lens.

According to the invention in a second aspect, a method of making a motor vehicle headlight cover lens, comprising a set of striations for lateral spreading of the light, of predetermined width, the striations being arranged to be associated with a reflector that produces beam portions divergent from at least one region which is substantially a point, is characterised in that the method comprises the steps which consist, for each beam portion, in:

establishing a base profile for each striation;

calculating for each striation, from the said base profile and the configuration of the radiation incident on that striation, a predetermined individual law of angular distribution;

calculating an aggregate angular distribution law for a group of striations exposed to the said beam portion; and adjusting iteratively the profile of each striation in order to obtain an essentially uniform aggregate angular distribution law.

Further features and advantages of the invention will appear more clearly on a reading of the following detailed description of a preferred embodiment of the invention, which is given by way of example only and with reference to the accompanying drawings.

DESCRIPTION OF A PREFERRED EMBODIMENT OF THE INVENTION

Figure 1:
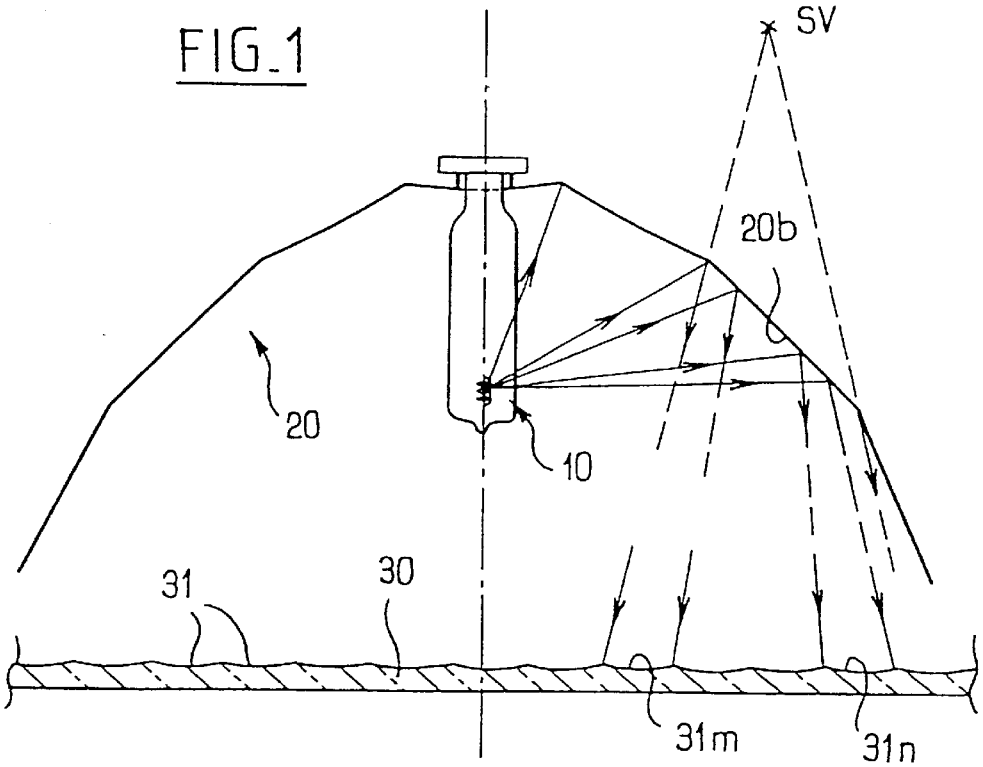
FIG. 1 is a diagrammatic view, in horizontal axial cross section, of a headlight according to the invention.
Figure 2:
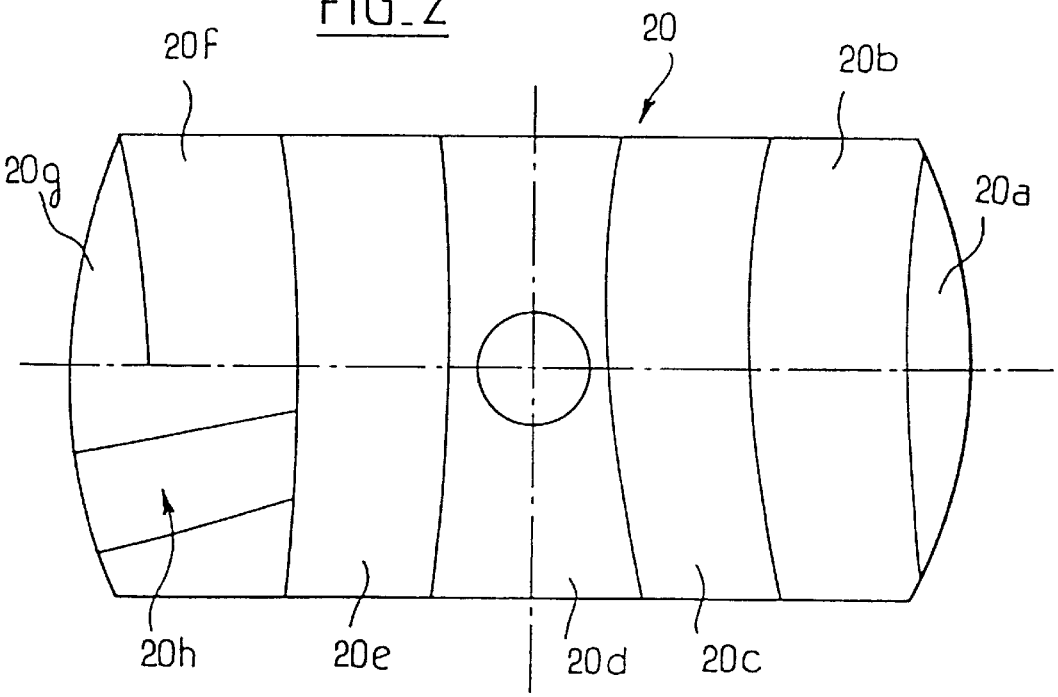
FIG. 2 is back view of the reflector of the headlight of FIG. 1.

With reference first to FIGS. 1 and 2, these show a headlight which includes a light source 10, a reflector 20, and a cover glass, or cover lens, 30.

The reflector 20 is shown in a back view in FIG. 2. It comprises a set of zones 20*a* to 20*h*, each of which is capable of generating part of a beam such as a dipped beam complying with European regulations, such that the beam which is generally obtained without intervention by the cover lens has an appropriate top cut-off, a large width, and good homogeneity.

These types of reflectors, which are now beginning to appear on some cars, may for example be made with the aid of surfaces which automatically generate cut-off, such as those described in numerous previous patents of the Company Valeo Vision, with striations superimposed on these surfaces for spreading the light. Up to the present time, in order not to affect adversely the beam produced by the cover lens, the latter has been smooth, or has been made with modifications for styling purposes only, such as fillets or the like, which have substantially no optical function.

Figure 3:
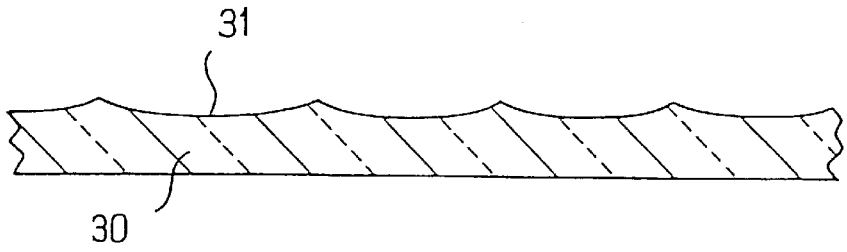
FIG. 3 is a view in horizontal cross section, on a larger scale, of the cover lens of the headlight.

In the cover lens according to the present invention shown in FIG. 3, to which reference is now made, the lens 30 is given a set of striations 31 which, in this example, are concave striations arranged on the inner surface of the lens. In orthogonal projection in a plane at right angles to the optical axis of the projector, these striations 31 are oriented vertically or in an orientation slightly inclined to the vertical.

In accordance with an essential feature of the invention, each striation has a radius of curvature which varies from its central region towards its edges, and more precisely it varies progressively between a maximum radius of curvature at the centre, indicated at RCc, and minimal radii of curvature in the region of its edges, these latter radii being denoted RCb.

Figure 4:
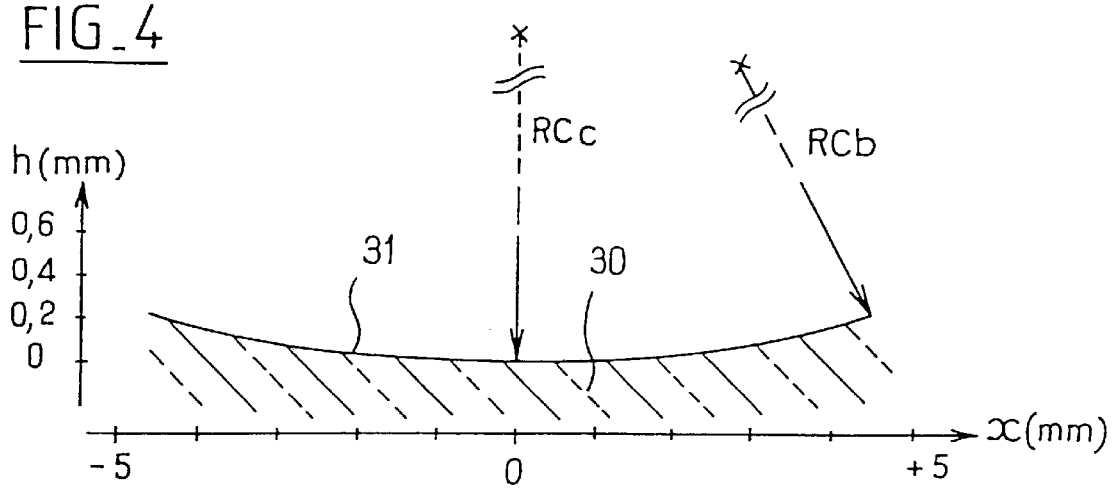
FIG. 4 shows the profile of one striation of the cover lens.

The profile of such a striation is shown in detail in FIG. 4, which shows the variation in the height h of the striation as a function of the horizontal dimension or abscissa x.

It will be recalled here that striations as conventionally provided on a headlight cover lens are cylindrical, having a circular profile and therefore a constant radius of curvature. The optical function of these striations is to spread the light uniformly between two limits, varying as a function of the above mentioned radius of curvature and as a function of the width of the striation. As a result, the lateral spreading characteristic of such a striation is a generally flat line, with sharp edges in the region of the two angular limits of deflection. The characteristic is therefore essentially linear or constant.

In this specification, a "spreading characteristic" is to be understood to mean the curve which characterises, for parallel incident radiation oriented at right angles to the flat face of the striation (in this case the exit face), the intensity I of the light at the exit of the striation as a function of the angle $\alpha$ of the deflection produced by the striation.

Figure 5:
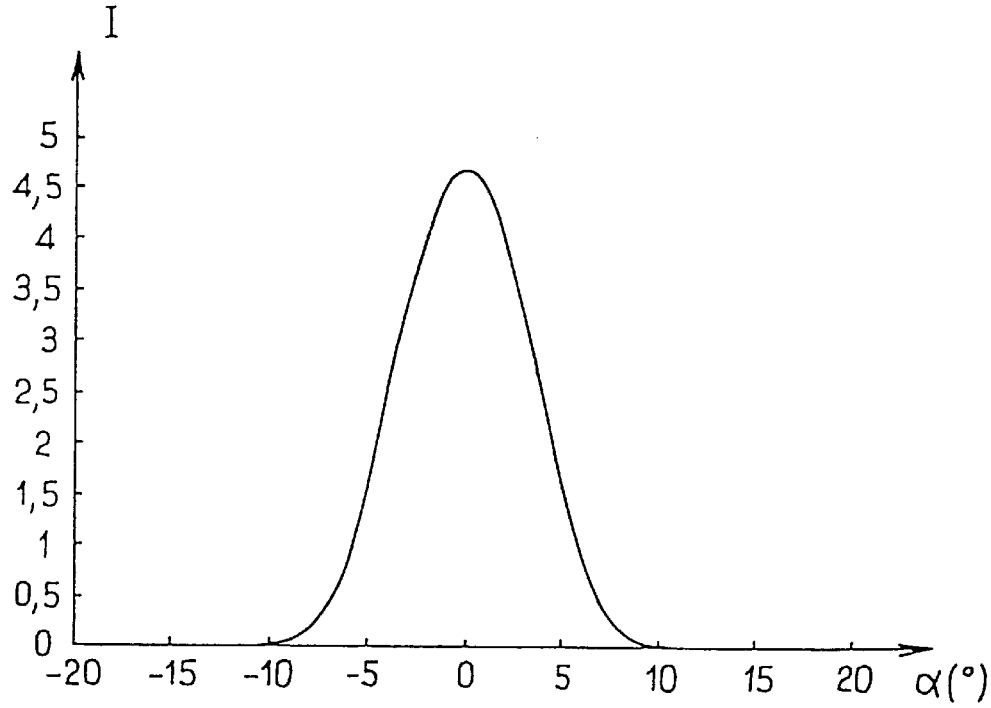
FIG. 5 shows the law of angular distribution in the striation of FIG. 4.

By contrast, with a striation according to the invention such as is defined above, the spreading characteristic has the appearance shown in FIG. 5. More precisely, given that the values of the radius of curvature are lowest in the central region of the striation, the latter will primarily produce output radiation which shows little deflection. The deflection becomes greater the nearer to the edges of the striation it is.

However, it will be understood that, because of this profile, the quantity of light which undergoes no deflection, or only slight deflection, is greater than the quantity of light which is deflected by a large amount, due to the fact that the zones having smaller radii of curvature are relatively more narrow than the zone having the larger radii of curvature, and due also to the fact that these zones with smaller radii of curvature therefore receive less light. As a result, and as shown in FIG. 5, there is a spreading characteristic $I=f(\alpha)$ of the Gauss curve type.

It will be noted here that the characteristic shown in FIG. 5 corresponds to a striation profile such as is shown in FIG. 4, in which the radius of curvature varies progressively from the centre towards the edges.

Naturally, it is also possible to provide a striation profile according to the invention in which the radius of curvature varies stepwise; the continuity of the surface of the striation, that is to say the absence of sudden changes in gradient, is of course preserved in that case.

As will be seen later herein, a spreading characteristic of a striation 31 with a variable radius of curvature of the type shown in FIG. 4 enables any substantial alteration in the photometry of a beam formed upstream by the single reflector 20 to be avoided.

First of all it will be observed that each zone 20*a*–20*h* of the reflector is adapted to produce a relatively homogenous spread in the light issuing from the source 10 and reflected by that zone of the reflector. Thus, it can be seen in FIG. 1 that two particular striations 31*m*, 31*n* receive from the zone 20*b* of the reflector two beam portions having a particular divergence, and it will be understood that the adjacent striations will receive the beam portions in which the mean angle of incidence will change progressively for example from a negative value to a positive value, essentially as though the light were coming from a virtual, or point, source denoted SV.

As a result, the orientation of the light leaving the lens through one particular striation will be determined by the combination of the general angle of incidence of the light on that particular striation and the particular spreading characteristic of that striation. In the remainder of this description, the expression "angular distribution law" is to be taken to mean the distribution of the intensity of the light output from the striation as a function of the angle of propagation $\alpha$ of the light ray on the output side of the striation. This law then takes account of, firstly the mean incidence angle and the aperture of an incident ray, and secondly the spreading characteristic of the striation.

Figure 6:
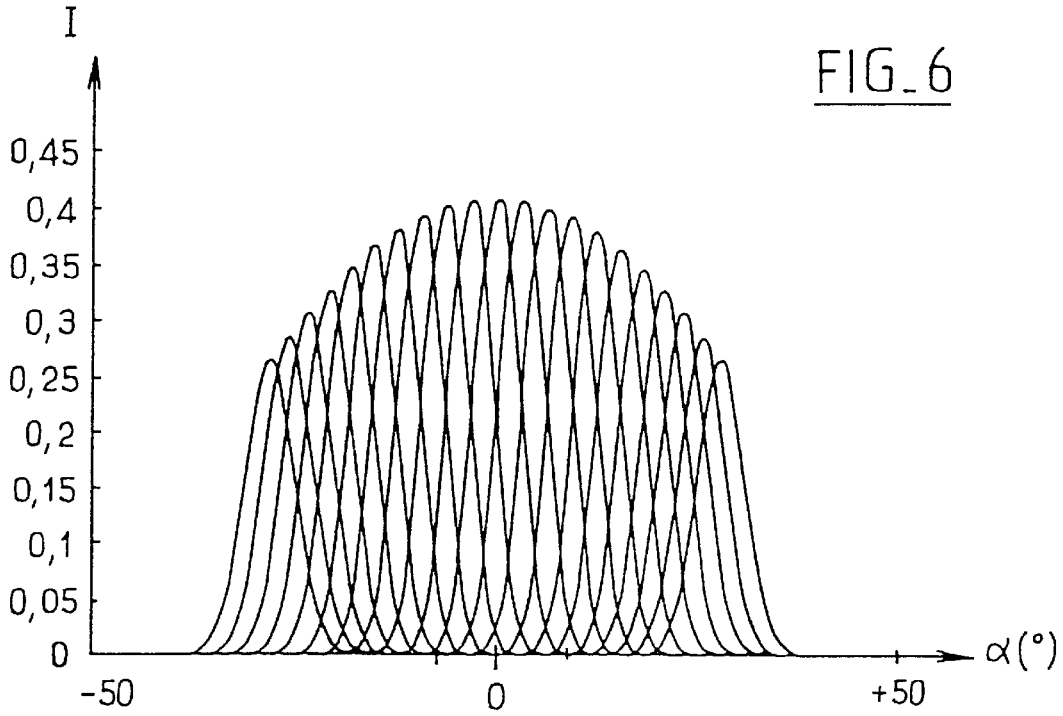
FIG. 6 shows the individual laws of angular distribution for a set of adjacent striations of the cover lens.

Thus, FIG. 6, to which reference is now made, shows the curves that represent the laws of individual distribution for a set of striations exposed to the part of the beam which is generated by one particular zone of the reflector. It will be observed that these different distribution laws, which remain approximately Gaussian, are offset laterally from each other. This offset corresponds to the fact that two adjacent striations will receive, from the zone in question of the reflector, beam portions of which the mean angles of incidence are slightly offset with respect to each other.

Figure 7:
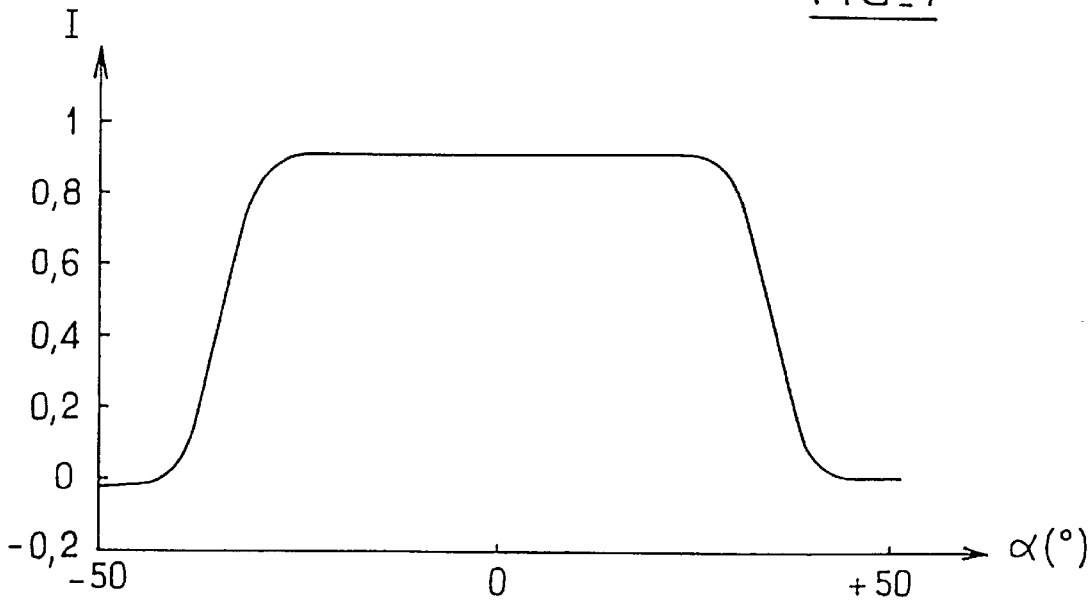
FIG. 7 shows the cumulative angular distribution of the same set of striations.

Now, the particular profile of each spreading characteristic, and that of each individual angular distribution law that results, is such that, if the cumulative distribution law of the set of striations is now determined, a distribution law such as that shown diagrammatically in FIG. 7 is obtained. With reference to FIG. 7, it can be seen that this cumulative distribution law is represented by a curve in which two side portions of the curve with comparatively sharp gradients are joined through a middle section, of substantially constant intensity I, which is essentially straight.

Thus, thanks to the particular profile of the striations, the aggregate of the deflection is such that homogeneity is preserved in the beam portion concerned, because the striated cover lens will superimpose on the spreading effect produced by the reflector an additional spreading effect which is characterised by the fact that no particular output direction is stronger than any other.

The various parameters affecting the design of the striations 31 may of course be varied, as will be explained in detail later herein. First of all, the spreading effect produced by the striation 31, which corresponds to the horizontal width of the distribution law curve, must not be excessive, in order not to dilute the beam produced by the reflector, and therefore in order also not to have adverse effects on its contours and its horizontal distribution.

It is then possible to vary the degree of overlap between the curves of the various individual distribution laws. In this regard, FIG. 6 shows on example in which each distribution law curve overlaps the five neighbouring curves on the left and the five neighbouring curves on the right. It will be understood that this degree of cover varies, firstly as a function of the spread appropriate to a striation, determined by its profile, and secondly as a function of the pitch between the apexes of the distribution law curves, which varies as a function of the horizontal pitch of the striations and the distance from the virtual light source SV.

It will be observed here that the greater the degree of overlap, in the sense of FIG. 6, the greater will then be the reduction in errors of homogeneity in the beam at the exit of the lens. This overlap is such that each individual angular distribution law curve overlaps at least two other neighbouring angular distribution law curves.

In practical terms, the design of the lens generally starts with a striation width which is imposed by the required styling criteria, having regard also to the technical limitations imposed by a given reflector. The pitch of the striations and the distance between the lens and the virtual sources corresponding to the various beam portions reaching the lens are therefore starting data. The profile of each striation is then adjusted precisely in order to obtain, for each beam portion, individual distribution law curves such that their aggregate will give a generally flat angular response, as in FIG. 7.

Figure 8:
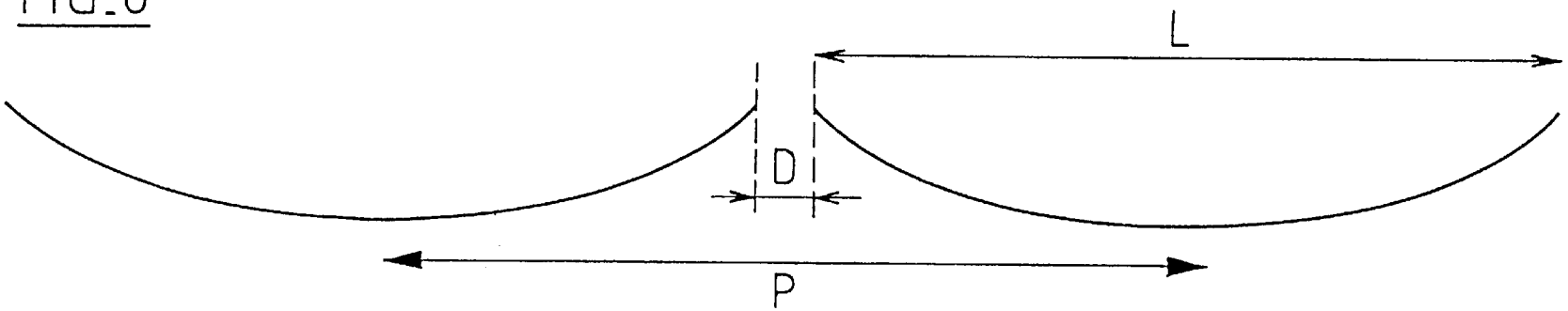
FIG. 8 shows one particular arrangement of striations.
Figure 9:
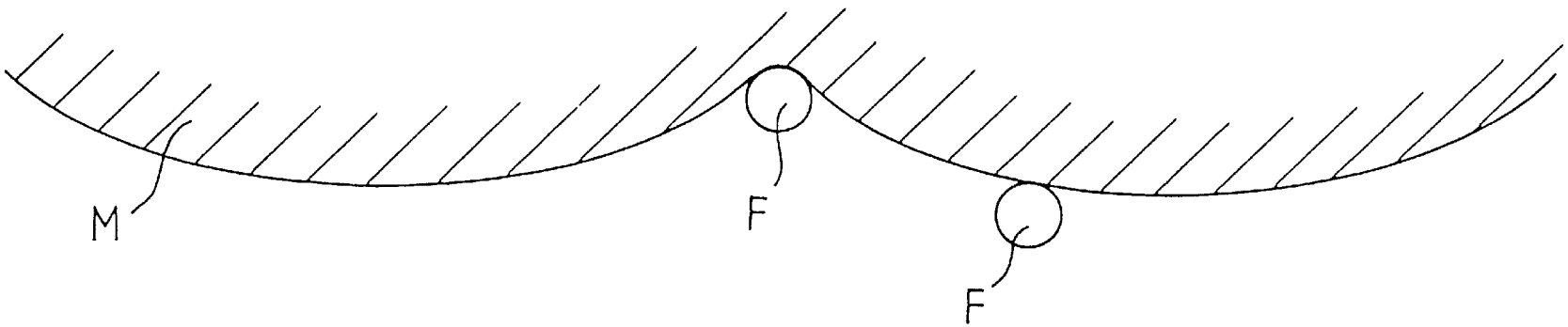
FIG. 9 shows how a mould for the cover lens, on the striation side of the latter, is made by milling, the striations being arranged to have the particular arrangement seen in FIG. 8.

With reference now to FIGS. 8 and 9, a particular arrangement of striations will now be described. This arrangement enables the mould used for forming a lens 30, in which the striations 31 are concave, to be configured by machining. The object is to carry out this machining using a single cylindrical milling cutter, or grinding tool, of a given diameter, for example 4 mm.

In this case, the striations, of width L are not arranged side by side but are instead arranged on a pitch P which is greater than the value of L, so that there exists between two adjacent striations a space of width D=P−L (see FIG. 8).

As a result, and now with reference to FIG. 9, the mould M can be machined using the milling cutter F mentioned above, by forming rounded portions at each transition between two adjacent striation zones, which completely avoids the difficulties normally encountered in making concave striations.

It will be noted here that these rounded portions, which cause strong local lateral spread of the light because of their small radius of curvature, are narrow enough to concern a very small proportion of the incident light, so that they therefore give rise to no perceptible defects in the final beam.

It will be noted here again that the indications given in FIGS. 4 to 7 correspond to a case in which the appropriate virtual light source SV is situated 150 mm from the lens 30, and in which the striations have a width of 9 mm and a pitch of 10 mm. A mould for a lens having such striations can be machined with a milling cutter of 4 mm diameter.

Preferably, the process of designing the lens in accordance with the invention consists first of all in modelling the various striations as though they lay in a general plane which is vertical and at right angles to the optical axis of the headlight. These model striations are then projected, in a conventional way, by appropriate computer means, on to a glass which does not have any curvature, and the half mould corresponding to the internal face of the lens is machined in accordance with the data of surface coordinates thus obtained.

It will be noted here that when a lens such as that defined above is to be used with a reflector which produces a European type dipped beam, that is to say a beam having a half cut-off which is raised (on the right or on the left according to whether the corresponding vehicle is to be left-hand drive or right-hand drive) by about 15° above the horizontal, it is well known that the light below this half cut-off must not be spread horizontally, so as to preserve the integrity of the half cut-off. In the present embodiment, this light is produced by the zone 20*h* of the reflector.

In order to satisfy this requirement, it can be arranged that the striations of the lens are interrupted in a zone which lies substantially in line with the zone 20*h* of the reflector. It may also be arranged that this region of the lens includes striations such as those described above, but inclined at 15° with respect to the vertical, so as to spread the light along the inclined half cut-off line.

The present invention is of course not in any way limited to the embodiment described above and shown in the drawings: a normal person skilled in this technical field will be able to apply to it any variation or modification which is in conformity with the spirit of the invention.

In particular, the concave striations described may be replaced by convex striations, or again by a combination of concave and convex striations, which may or may not be arranged alternately with each other.

In addition, although all of the striations 31 preferably have the same profile and therefore the same spreading characteristic, different profiles can be provided in a group of striations adjacent to another, or even between one striation and another, so long as the striations all retain a similar appearance when the headlight is extinguished.

What is claimed is:

1. A motor vehicle headlight comprising:

a light source;

a reflector associated with the light source for reflecting light forward from the source; and a cover lens in front of the reflector and the light source, the reflector being adapted to produce a preformed light beam, the lens being so disposed in relation to the reflector that the lens receives, from at least a substantial part of the reflector, divergent radiation defining a mean angle of incidence in a horizontal plane which varies progressively with horizontal displacement on the lens, wherein the lens defines a zone thereof covered by the divergent radiation, the lens including, at least in the zone covered by the divergent radiation, a set of striations for lateral deflection of the light when the striations are exposed to the divergent radiation, each striation defining an individual angular distribution law determined by the orientation of the light received from the part of the reflector by that striation and by the lateral distribution characteristic of the same striation, the spreading characteristic of the striations being so determined that the aggregate angular distribution law of the striations is essentially uniform.

2. A headlight according to claim 1, wherein each striation has a profile in a horizontal plane defining a radius of curvature smaller in the region of its side edges than in its central region.

3. A headlight according to claim 2, wherein the said radius of curvature of each striation diminishes progressively from its central region towards its edges.

4. A headlight according to claim 1, wherein the individual angular distribution law of each striation, represented by a curve, overlaps at least two neighbouring similar curves.

5. A headlight according to claim 1, wherein all of the striations have the same profile.

6. A headlight according to claim 1, wherein the lens includes a zone from which striations are absent.

7. A headlight according to claim 1, wherein the striations are concave.

8. A headlight according to claim 7, wherein the striations are arranged on a pitch slightly greater than the width of each striation, the lens defining rounded transitions between adjacent striations.

9. A headlight according to claim 8, wherein the cover lens has been formed by moulding in a mould, the mould having previously been machined using a single cylindrical milling cutter, the lens defining, for each said rounded transition, a constant radius of curvature equal to the radius of the said tool.

10. A method of making a motor vehicle headlight cover lens having a set of striations for lateral spreading of light emitted by the headlight, each striation being of predetermined width, the headlight including the cover lens and a reflector associated with the cover lens for producing beam portions which are divergent from at least one region which is substantially a point, the method comprising, for each beam portion, the steps of:

establishing a base profile for each striation;

calculating for each striation, from the base profile and from the required configuration of the radiation incident on the striation, a predetermined individual angular distribution law;

calculating an aggregate angular distribution law for the group of striations to be exposed to the beam portion; and iteratively adjusting the profile of each striation and obtaining therefrom an essentially uniform aggregate angular distribution law.

11. A motor vehicle headlight comprising:

a light source;

a reflector associated with the light source for reflecting light forward from the light source, the reflector being defined by a set of surfaces of different inclination relative to the light source for reflecting light emanating from the light source to produce a substantially homogenous light beam; and a cover lens positioned in front of the reflector and the light source for lateral deflection of the substantially homogenous light beam, the cover lens having an inner surface facing the light source with a set of concave striations thereon, each striation having a radius of curvature which varies from a maximum radius at its center region to a minimal radius at its edges, wherein adjacent striations receive the beam in which a mean angle of incidence changes progressively as though the beam originates from a virtual source, and wherein the intensity of light exiting from a striation is a function of an angle of deflection produced by that striation.

12. A headlight according to claim 11, wherein the height of a striation increases progressively from its center region towards the edges.

13. A headlight according to claim 11, wherein the individual angular distribution law of each striation, represented by a curve, overlaps at least two neighboring curves.

14. A headlight according to claim 11 wherein the set of striations are set apart from one another to include a narrow bridge between two neighboring striations wherein the bridge has a convex surface.

15. A headlight according to claim 11 wherein the cover lens includes a region without a striation.

* * * * *